US008624524B2

(12) United States Patent
Liu et al.

(10) Patent No.: US 8,624,524 B2
(45) Date of Patent: Jan. 7, 2014

(54) POWER MANAGEMENT AND CONTROL MODULE AND LIQUID CRYSTAL DISPLAY DEVICE

(75) Inventors: Kang-Yi Liu, Hsin-Chu (TW); Chao-Chieh Chen, Hsin-Chu (TW); Chia-Ming Wu, Hsin-Chu (TW); Chao-Kai Huang, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 266 days.

(21) Appl. No.: 13/278,276

(22) Filed: Oct. 21, 2011

(65) Prior Publication Data

US 2012/0146520 A1 Jun. 14, 2012

(30) Foreign Application Priority Data

Dec. 10, 2010 (TW) ..... 99143310 A

(51) Int. Cl.
*G05F 1/00* (2006.01)

(52) U.S. Cl.
USPC ..... 315/291

(58) Field of Classification Search
USPC ..... 315/291, 192, 299, 307, 312; 345/690, 345/691, 87, 76, 90, 102, 101, 104, 105, 345/204
See application file for complete search history.

(56) References Cited

U.S. PATENT DOCUMENTS

| | | | | |
|---|---|---|---|---|
| 7,427,985 | B2 | 9/2008 | Chen et al. | |
| 2004/0012551 | A1 * | 1/2004 | Ishii | 345/87 |
| 2006/0164370 | A1 * | 7/2006 | Park et al. | 345/98 |
| 2008/0158246 | A1 * | 7/2008 | Ishii et al. | 345/604 |
| 2008/0198118 | A1 * | 8/2008 | Choi | 345/89 |
| 2010/0073275 | A1 * | 3/2010 | Kim | 345/102 |

* cited by examiner

*Primary Examiner* — Minh D A
(74) *Attorney, Agent, or Firm* — WPAT, PC; Justin King

(57) ABSTRACT

A power management and control module adapted for a liquid crystal display device includes a boost-type DC/DC topology circuit, a LED dimming control circuit and a multiplexer. The boost-type DC/DC topology circuit has a voltage output terminal electrically connected with a logic high power supply terminal of a gate driving circuit and a power supply terminal of a LED backlight source. The LED dimming control circuit is electrically connected with the LED backlight source for dimming operation. A first and second data input terminals of the multiplexer are electrically connected to the voltage output terminal through a first and second feedback networks respectively. The LED backlight source is electrically connected in the second feedback network. A data output terminal of the multiplexer is electrically connected to the boost-type DC/DC topology circuit and alternatively communicated with the first or second data input terminal to provide a feedback input voltage.

15 Claims, 3 Drawing Sheets

POWER MANAGEMENT AND CONTROL MODULE AND LIQUID CRYSTAL DISPLAY DEVICE

TECHNICAL FIELD

The disclosure relates to display technologies, and more particularly to a power management and control module and a liquid crystal display device.

BACKGROUND

With the development of science and technology, flat panel display devices (e.g., liquid crystal display devices) have many advantages of high display quality, small volume, light weight and wide application range and thus are widely used in consumer electronics products such as mobile phones, laptop computers, desktop computers and televisions, etc. Moreover, the liquid crystal display devices have evolved into a mainstream display in place of cathode ray tube (CRT) displays.

In order to achieve the purposes of image contrast improvement, color optimization and low power consumption, backlight sources of liquid crystal display devices have been gradually changed from cold cathode fluorescent lamps to light emitting diodes. FIG. 1 illustrates a schematic system architecture of a conventional liquid crystal display device 10 using a LED backlight source. In particular, the liquid crystal display device 10 includes a timing controller 11, a DC/DC (i.e., direct current to direct current) converter 12, a negative charge pump circuit 13, a LED driver 14, a gate driving circuit 15, a source driving circuit 16, a liquid crystal display panel 17 and a LED backlight source 18. The DC/DC converter 12, the negative charge pump circuit 13 and the LED driver 14 as a whole are termed as power management and control module 19. Generally, the DC/DC converter 12 has a group of boost-type DC/DC topology circuit included therein, and the LED driver 14 has another group of boost-type DC/DC topology circuit included therein. A primary principle of the liquid crystal display device 10 will be described as follows. More specifically, the timing controller 11 receives image data LVDS_DATA from a system end 20 to generate display driving signals to the gate driving circuit 15 and the source driving circuit 16 and thereby for image display on the liquid crystal display panel 17. The DC/DC converter 12 receives an input voltage VIN and a pulse width modulation signal PWM_EN from the system end 20 to generate voltage signals AVDD, V_LOGIC and VGH respectively for a power supply terminal of the source driving circuit 16, a power supply terminal of the timing controller 11 and a logic high power supply terminal of the gate driving circuit 15. The negative charge pump circuit 13 externally connected to the DC/DC converter 12 generates a voltage signal VGL for a logic low power supply terminal of the gate driving circuit 15. The LED driver 14 receives another input voltage VLED_EN from the system end 20 and thereby performs a DC boost operation to generate an analog high voltage signal VLED_OUT for driving the LED backlight source 18. An enable signal VLED_EN inputted to the LED driver 14 from the system end 20 is for controlling whether to turn on the LED backlight source 18.

However, the circuit for generating the voltage signal VGH and the driver for the LED backlight source 18 respectively are individual circuit blocks, so that the usage area of printed circuit board assembly (PCBA), the amount of circuit traces and the power consumption of whole system are large consequently.

SUMMARY

Accordingly, in one aspect, a power management and control module in accordance with an embodiment of the disclosure is applied to a display device equipped with a gate driving circuit, a source driving circuit and a LED backlight source. In particular, the power management and control module includes a first boost-type DC/DC topology circuit, a LED dimming control circuit and a first multiplexer. The first boost-type DC/DC topology circuit has a first voltage output terminal. The first voltage output terminal is electrically coupled to a logic high power supply terminal of the gate driving circuit and a power supply terminal of the LED backlight source. The LED dimming control circuit is adapted to electrically couple to the LED backlight source for dimming operation. The first multiplexer has a first data input terminal, a second data input terminal and a first data output terminal, the first and second data input terminals are electrically coupled to the first voltage output terminal of the first boost-type DC/DC topology respectively by a first feedback network and a second feedback network. The LED backlight source is arranged in the second feedback network. The first data output terminal is electrically coupled to the first boost-type DC/DC topology circuit and alternatively electrically communicated with the first data input terminal or the second data input terminal to provide the first boost-type DC/DC topology circuit with a feedback input voltage.

In another aspect, a liquid crystal display device in accordance with an embodiment of the disclosure includes a source driving circuit, a gate driving circuit, a LED backlight source and a power management and control chip. The LED backlight source includes multiple individual LED strings for providing backlight illumination. The power management and control chip has a first voltage output terminal, a second voltage output terminal, a first feedback input terminal and multiple second feedback input terminals. The first voltage output terminal is electrically coupled to a logic high power supply terminal of the gate driving circuit and a power supply terminal of the LED backlight source. The second voltage output terminal is electrically coupled to a power supply terminal of the source driving circuit and further electrically coupled to the first voltage output terminal by a first switching element. The first feedback input terminal is electrically coupled to the first voltage output terminal by a first feedback network. The second feedback input terminals are electrically coupled to the first voltage output terminal by a second feedback network. The LED backlight source is arranged in the second feedback network. Moreover, when the power management and control chip is powered on, the first feedback network and the second feedback network are alternatively turned on.

BRIEF DESCRIPTION OF THE DRAWINGS

The embodiments of the disclosure will become more readily apparent to those ordinarily skilled in the art after reviewing the following detailed description and accompanying drawings, in which.

DETAILED DESCRIPTION OF EMBODIMENTS

The disclosure will now be described more specifically with reference to the following embodiments. It is to be noted that the following descriptions of embodiments of this disclosure are presented herein for purpose of illustration and description only. It is not intended to be exhaustive or to be limited to the precise form disclosed.

Figure 1:
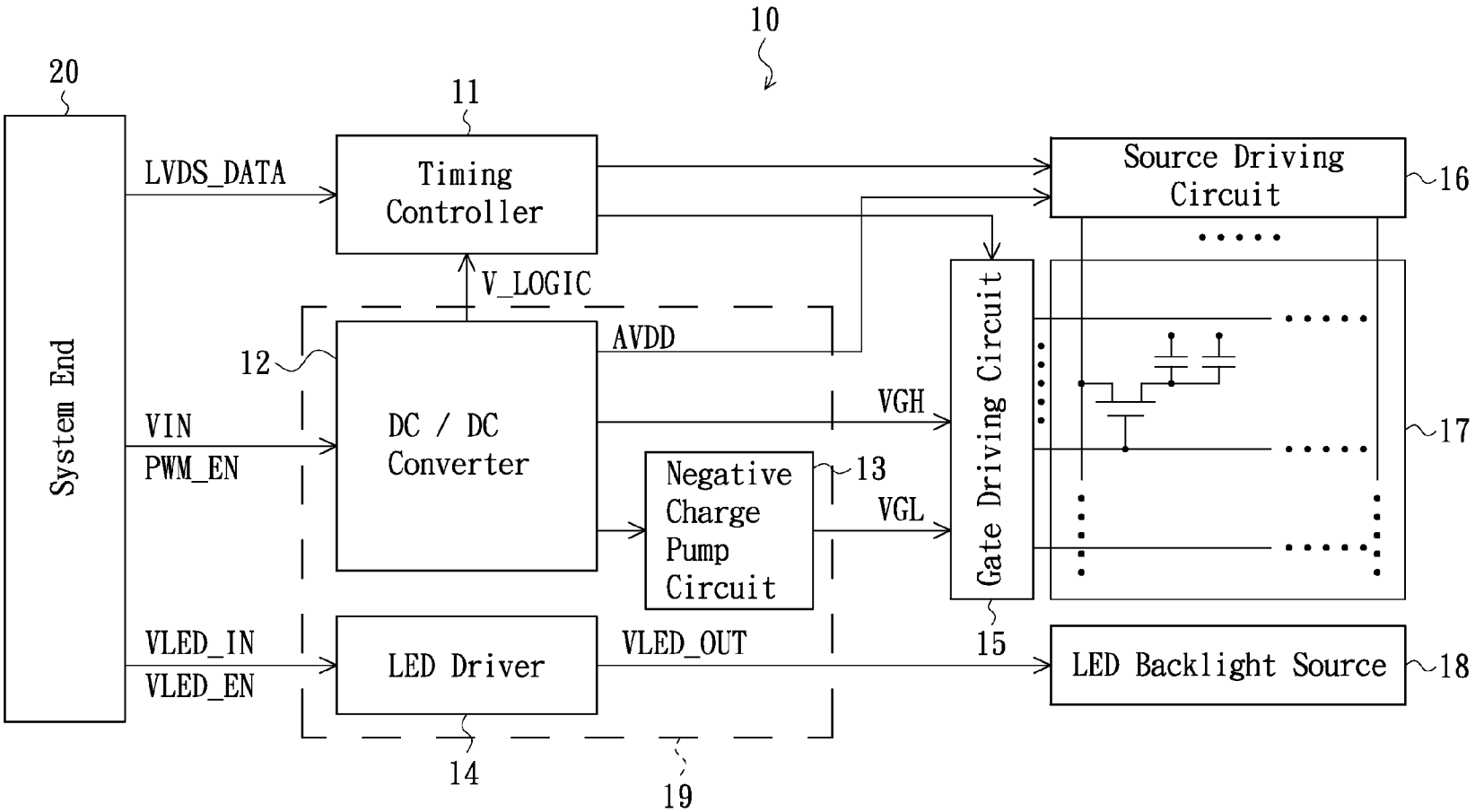
FIG. 1 (Related Art)
FIG. 1 is a schematic system architecture view of a conventional liquid crystal display device.
Figure 2:
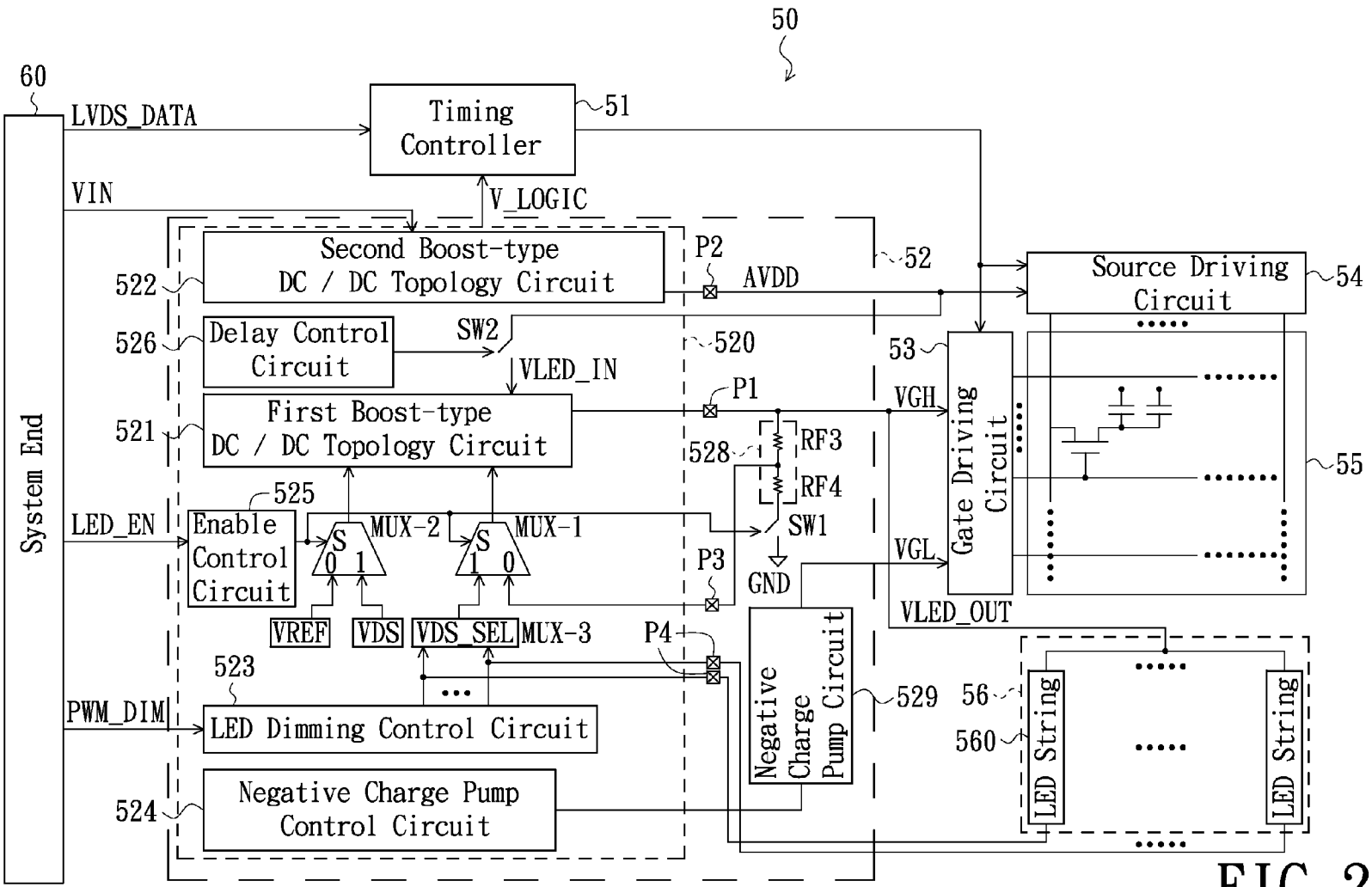
FIG. 2 is a schematic system architecture view of a conventional liquid crystal display device in accordance with an embodiment of the disclosure.

Referring to FIG. 2, a schematic system architecture view of a liquid crystal display device in accordance with an embodiment of the present is shown. As illustrated in FIG. 2, the liquid crystal display device 50 includes a timing controller 51, a power management and control module 52, a gate driving circuit 53, a source driving circuit 54, a liquid crystal display panel 55 and a LED backlight source 56.

The timing controller 51 receives image data LVDS_DATA from a system end 60 and thereby converts the received image data LVDS_DATA into display driving signals for the gate driving circuit 53 and the source driving circuit 54 so as to achieve image display on the liquid crystal display panel 55. The gate driving circuit 53 may include one or multiple gate driving chips. The gate driving circuit 53 may be directly manufactured on a substrate of the liquid crystal display panel 55 by a gate-on-array (GOA) technique instead and correspondingly the gate driving circuit 53 can be formed in a single-side or double-sided manner with respect to the liquid crystal display panel 55. The source driving circuit 54 may include multiple source driving chips and a gamma voltage generation circuit. Moreover, the LED backlight source 56 includes multiple individual LED strings 560 connected in parallel to provide backlight illumination for the liquid crystal display panel 55.

The power management and control module 52 includes a power management and control chip 520, a switching element SW1, a voltage-divide circuit 528 and a negative charge pump circuit 529. The switching element SW1, the voltage-divide circuit 528 and the negative charge pump circuit 529 are externally electrically coupled to the power management and control chip 520. The power management and control chip 520 includes a first boost-type DC/DC topology circuit 521, a second boost-type DC/DC topology circuit 522, a LED dimming control circuit 523, a negative charge pump control circuit 524, an enable control circuit 525, a delay control circuit 526, a switching element SW2 and multiplexers MUX-1, MUX-2, MUX-3. Moreover, the power management and control chip 520 has a first voltage output terminal P1, a second voltage output terminal P2, a first feedback input terminal P3 and multiple second feedback input terminals P4.

In the power management and control chip 520, the second boost-type DC/DC topology circuit 522 is electrically coupled to the system end 60 to receive an input voltage VIN provided from the system end 60 and further electrically coupled to a power supply terminal of the source driving circuit 54 by the second voltage output terminal P2. The second voltage output terminal P2 further is electrically coupled to the first boost-type DC/DC topology circuit 521 by the switching element SW2 for selectively providing the first boost-type DC/DC topology circuit 521 with an input voltage VLED_IN according to on-off states of the switching element SW2. The on-off states of the switching element SW2 are determined by the delay control circuit 526. In particular, the switching element SW2 may be a transistor, the source/drain of the transistor is electrically coupled to the second voltage output terminal P2, and the delay control circuit 526 is electrically coupled to the gate of the transistor to thereby obtain a voltage on the second voltage output terminal P2 by a parasitic capacitive coupling effect between the gate and the source/drain of the transistor. Moreover, the first boost-type DC/DC topology circuit 521 is electrically coupled to a logic high power supply terminal of the gate driving circuit 53 and a power supply terminal of the LED backlight source 56 by the first voltage output terminal P1 to provide voltage signals VGH and VLED_OUT.

The data input terminal 1 of the multiplexer MUX-1 is electrically coupled to the second feedback input terminals P4 by the multiplexer MUX-3 and thereby electrically coupled to the first voltage output terminal P1 by a second feedback network. Herein, the LED backlight source 56 is arranged in the second feedback network. The data input terminal 0 of the multiplexer MUX-1 is electrically coupled to the first feedback input terminal P3 and thereby electrically coupled to the first voltage output terminal P1 by a first feedback network. Herein, the first feedback network includes a voltage-divide circuit 528 and a switching element SW1. The voltage-divide circuit 528 and the switching element SW1 are in series electrically coupled between the first voltage output terminal P1 and a preset voltage e.g., the grounding level GND. The voltage-divide circuit 528 is selectively electrically communicated with the grounding level GND according to on-off states of the switching element SW1. A control terminal of the switching element SW1 is electrically coupled to the enable control circuit 525 and thereby subjected to the control of the enable control circuit 525. More specifically, the voltage-divide circuit 528 includes voltage-divide resistors RF3 and RF4 connected in series. The first feedback input terminal P3 is electrically coupled to a node between the series-connected voltage-divide resistors RF3 and RF4. The switching element SW1 may be a transmission gate. The data output terminal of the multiplexer MUX-1 is electrically coupled to the first boost-type DC/DC topology circuit 521 to provide a feedback input voltage to the first boost-type DC/DC topology circuit 521. The select terminal S of the multiplexer MUX-1 is electrically coupled to the enable control circuit 525 and thereby subjected to the control of the enable control circuit 525, so that the data output terminal of the multiplexer MUX-1 is alternatively electrically communicated with the data input terminal 0 or the data input terminal 1 of the multiplexer MUX-1.

The data input terminals 0 and 1 of the multiplexer MUX-2 are respectively electrically coupled to reference voltages VREF and VDS. The data output terminal of the multiplexer MUX-2 is electrically coupled to the first boost-type DC/DC topology circuit 521 to provide a feedback reference voltage to the first boost-type DC/DC topology circuit 521. As a result, the first boost-type DC/DC topology circuit 521 can dramatically regulate the voltage outputted from the first voltage output terminal P1 according to the comparing result between the feedback input voltage and the feedback reference voltage. The select terminal S of the multiplexer MUX-2 is electrically coupled to the enable control circuit 525 and thereby subjected to the control of the enable control circuit 525, so that the data output terminal of the multiplexer MUX-2 is alternatively electrically communicated with the data input terminal 0 or the data input terminal 1 of the multiplexer MUX-2. In addition, the enable control circuit 525 receives an enable signal LED_EN from the system end 60 as a control signal thereof.

The LED dimming control circuit 523 is electrically coupled to data input terminals of the multiplexer MUX-3 to provide voltage signals VDS_SEL and further electrically coupled to the LED strings 560 by the respective second feedback input terminals P4. Herein, each of the voltage signals VDS_SEL is a voltage on a terminal (which is electrically coupled to a corresponding one of the second feedback input terminals P4) of the turned on LED string. The LED dimming control circuit 523 primarily includes a constant current source circuit and multiple current sink circuits as well-known. Herein, the LED dimming control circuit 523 receives a dimming control signal PWM_DIM provided from the system end 60 to thereby perform a dimming operation to the respective LED strings 560.

The negative charge pump control circuit 524 is electrically coupled to a logic low power supply terminal of the gate driving circuit 53 by the externally connected negative charge pump circuit 529. Herein, the negative charge pump control circuit 524 primarily includes a comparator, an oscillator, a multiplexer and transistors to thereby provide the negative charge pump circuit 529 with an input voltage, and the input voltage then is converted into a low logic power supply voltage signal VGL as an output by electronic components such as multiple diodes and capacitors in the negative charge pump circuit 529.

It is noted that, the above first boost-type DC/DC topology circuit 521, multiplexers MUX-1~MUX-3, enable control circuit 525 and LED dimming control circuit 523 as a whole are used as LED driving circuit block in the power management and control chip 520, and the LED driving circuit block is provided with an input voltage VLED_IN by the second boost-type DC/DC topology circuit 522 in the power management and control chip 520. In addition, the enable control circuit 525, the multiplexers MUX-1, MUX-2, the voltage-divide circuit 528 and the switching element SW1 as a whole are termed as timing control auxiliary circuit.

Figure 3:
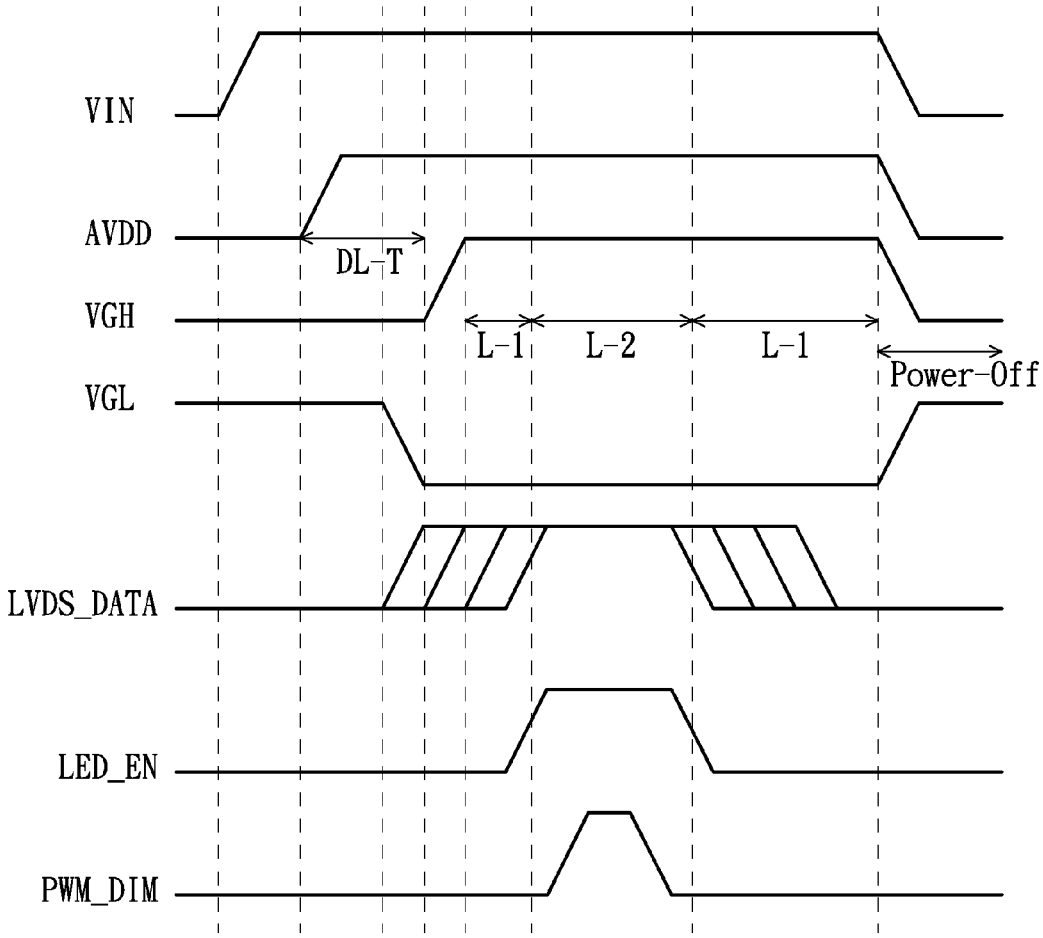
FIG. 3 is a timing diagram of multiple signals of the liquid crystal display device as illustrated in FIG. 2.

An operation process of the power management and control module 52 in the liquid crystal display device 50 in accordance with an embodiment of the disclosure will be described below in detail accompanying with the drawings of FIGS. 2 and 3. FIG. 3 illustrates a timing diagram of multiple signals related to the liquid crystal display device 50.

Specifically, when the system end 60 provides the input voltage VIN to the liquid crystal display device 50 to power on the power management and control chip 520, the second boost-type DC/DC topology circuit 522 is started to generate an analog voltage signal AVDD to the source driving circuit 54 for use.

When the delay control circuit 526 detects the level of the analog voltage signal AVDD arrives at a preset level, i.e., after delaying a time interval DL-T, the switching element SW2 is turned on to allow the analog voltage signal AVDD to be inputted into the first boost-type DC/DC topology circuit 521 as the input voltage VLED_IN, and thereby the LED driving circuit block in the power management and control chip 520 is enabled. The first voltage output terminal P1 of the LED driving circuit block is directly connected to the logic high power supply terminal of the gate driving circuit 53 to provide a high logic power supply voltage signal VGH for use.

Since the image data LVDS_DATA provided from the system end 60 is not ready (i.e., invalid data), the enable signal LED_EN outputted from the system end 60 is at disable state (logic low), the LED backlight source 56 is at off state. Based on the specification definition of the system end 60 to a power on sequence of the gate driving circuit 53, when the enable signal LED_EN is at logic low level, the analog multiplexers MUX-1, MUX-2 in the power management and control chip 520 set the reference voltage VREF as the feedback reference voltage of the first boost-type DC/DC topology circuit 521, the switching element SW1 is turned on and thereby the voltage-divide resistors RF3, RF4 and the switching element SW1 together constitute the first feedback network. At this moment, the voltage signal outputted from the first voltage output terminal P1 is LED_OUT=VGH=VREF*(1+RF3/RF4) (as depicted by the left L-1 stage in FIG. 3) and used as the voltage signal VGH required by the logic high power supply terminal of the gate driving circuit 53 during the LED backlight source 56 is turned off, so as to avoid the occurrence of abnormal images during power on stage resulting from floating voltage signal on the logic high power supply terminal of the gate driving circuit 53 and also to avoid violating the power on sequence defined by the system end 60.

When the enable signal LED_EN outputted from the system end 60 is at enable state (high level), the LED backlight source 56 is turned on and the image data LVDS_DATA provided from the system end 60 is ready (i.e., valid data). At this moment, the analog multiplexers MUX-1, MUX-2 in the power management and control chip 520 automatically set the reference voltage VDS as the feedback reference voltage of the first boost-type DC/DC topology circuit 521 and further set the voltage signal VDS_SEL as the feedback input voltage. In this situation, the second feedback network is selected, and the voltage signal outputted from the first voltage output terminal P1 is LED_OUT=VGH (as depicted by the L-2 stage in FIG. 3). The value of such voltage signal is determined by the reference voltage VDS and the LED amount and forward voltage in one corresponding LED string 560 and ideally is set to be equal to [VREF*(1+RF3/RF4)]. During the L-2 stage, the voltage signal outputted from the first voltage output terminal P1 is taken as the power supply voltage signal VLED_OUT required to turn on the LED backlight source 56 as well as the voltage signal required by the logic high power supply terminal of the gate driving circuit 53. Moreover, during the enable signal LED_EN is at the enable state, the LED dimming control circuit 523 can be controlled by the dimming control signal PWM_DIM to perform local dimming operations to the respective LED strings 560 of the LED backlight source 56.

During a control process of power-off sequence, when the enable signal LED_EN outputted from the system end 60 and the dimming control signal PWM_DIM both are at disable states, the LED backlight source 56 is turned off and thereby the control process automatically switches to the L-1 stage (as depicted in the right of FIG. 3). The voltage signal outputted from the first voltage output terminal P1 is LED_OUT=VGH=VREF*(1+RF3/RF4) (regardless of the image data LVDS_DATA being valid or invalid, the LED backlight source 56 is turned off) until the voltage signal AVDD outputted from the second boost-type DC/DC topology circuit 522 and the input voltage VIN are closed. As a result, the power-off sequence defined by the system end 60 is completed and without being violated.

Sum up, in the various embodiments of the disclosure, owing to the circuit block for driving the LED backlight source and the DC/DC topology circuit for generating the power supply voltage of the source driving circuit may be integrated into a single chip, accompanying with the use of the multiplexers and feedback networks, the voltage signal outputted form the first voltage output terminal can be used as the high logic power supply voltage required by the gate driving circuit as well as the power supply voltage required by the LED backlight source. Accordingly, the usage area of PCBA can be decreased, the circuit traces can be simplified and the power consumption of whole system can be reduced. In addition, compared with the situation of the DC/DC converter using two groups of boost-type DC/DC topology circuits in the prior art (one group of boost-type DC/DC topology circuits is arranged in the DC/DC converter 12, while the other one group of boost-type DC/DC topology circuit is arranged in the LED driver 14), the disclosure uses the group of boost-type topology circuit originally arranged in the LED driver 14 to produce the high logic power supply voltage, the used amount of boost-type DC/DC topology circuits can be reduced to be one group, so that the manufacture cost of whole system can be reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A power management and control module adapted for a display device comprising a gate driving circuit, a source driving circuit and a LED backlight source, the power management and control module comprising:

a first boost-type DC/DC topology circuit, comprising a first voltage output terminal, wherein the first voltage output terminal is electrically coupled to a logic high power supply terminal of the gate driving circuit and a power supply terminal of the LED backlight source;

a LED dimming control circuit, electrically coupled to the LED backlight source for performing a dimming operation to the LED backlight source; and a first multiplexer, comprising a first data input terminal, a second data input terminal and a first data output terminal, wherein the first data input terminal and the second data input terminal are electrically coupled to the first voltage output terminal of the first boost-type DC/DC topology circuit by a first feedback network and a second feedback network respectively, the LED backlight source is electrically coupled in the second feedback network, and the first data output terminal is electrically coupled to the first boost-type DC/DC topology circuit to thereby alternatively electrically communicate with the first data input terminal or the second data input terminal for providing the first boost-type DC/DC topology circuit with a feedback input voltage.

2. The power management and control module according to claim 1, further comprising:

an enable control circuit, electrically coupled to the first multiplexer for enabling the first multiplexer to alternatively electrically communicate the first data output terminal with the first data input terminal or the second data input terminal.

3. The power management and control module according to claim 2, further comprising:

a second multiplexer, comprising a third data input terminal, a fourth data input terminal and a second data output terminal, wherein the third data input terminal and the fourth data input terminal respectively are electrically coupled to a first reference voltage and a second reference voltage, the second data output terminal is electrically coupled to the first boost-type DC/DC topology circuit and alternatively electrically communicated with the third data input terminal or the fourth data input terminal for providing the first boost-type DC/DC topology circuit with a feedback reference voltage according to the control of the enable control circuit to the second multiplexer.

4. The power management and control module according to claim 2, wherein the first feedback network comprises a voltage-divide circuit and a switching element, the voltage-divide circuit and the switching element are in series electrically coupled between the first voltage output terminal and a preset voltage, the enable control circuit is for controlling on-off states of the switching element to thereby control the voltage-divide circuit selectively to electrically communicate with the preset voltage according to the on-off states of the switching element.

5. The power management and control module according to claim 1, further comprising:

a third multiplexer, wherein the second data input terminal of the first multiplexer is electrically coupled to the second feedback network by the third multiplexer.

6. The power management and control module according to claim 1, further comprising:

a negative charge pump control circuit, electrically coupled to a logic low power supply terminal of the gate driving circuit by a negative charge pump circuit.

7. The power management and control module according to claim 1, further comprising:

a second boost-type DC/DC topology circuit, comprising a second voltage output terminal, wherein the second voltage output terminal is electrically coupled to a power supply terminal of the source driving circuit and further electrically coupled to the first boost-type DC/DC topology circuit by a switching element; and a delay control circuit, for detecting a voltage on the second voltage output terminal and thereby enabling the switching element to allow the second voltage output terminal to provide the first boost-type DC/DC topology circuit with an input voltage when the detected voltage arrives at a preset voltage.

8. The power management and control module according to claim 7, wherein the switching element is a transistor, the delay control circuit is electrically coupled to a gate of the transistor and thereby obtains the voltage on the second voltage output terminal by a parasitic capacitive coupling effect between the gate and a source/drain of the transistor.

9. A liquid crystal display device comprising:

a source driving circuit;

a gate driving circuit;

a LED backlight source, comprising a plurality of individual LED strings for providing backlight illumination; and a power management and control chip, comprising a first voltage output terminal, a second voltage output terminal, a first feedback input terminal and a plurality of second feedback input terminals, wherein the first voltage output terminal is electrically coupled to a logic high power supply terminal of the gate driving circuit and a power supply terminal of the LED backlight source, the second voltage output terminal is electrically coupled to a power supply terminal of the source driving circuit and further electrically coupled to the first voltage output terminal by a first switching element, the first feedback input terminal is electrically coupled to the first voltage output terminal by a first feedback network, and the second feedback terminals are electrically coupled to the first voltage output terminal by a second feedback network and whereby the LED backlight source is electrically coupled in the second feedback network;

wherein when the power management and control chip is powered on, the first feedback network and the second feedback network are alternatively turned on.

10. The liquid crystal display device according to claim 9, wherein the first feedback network comprises a voltage-divide circuit and a second switching element, the voltage-divide circuit and the second switching element are in series electrically coupled between the first voltage output terminal and a preset voltage, the second switching element is subjected to the control of the power management and control chip to control the voltage-divide circuit to selectively electrically communicate with the preset voltage according to on-off states of the second switching element.

11. The liquid crystal display device according to claim 9, wherein the power management and control chip comprises:

a first boost-type DC/DC topology circuit, electrically coupled to the logic high power supply terminal of the gate driving circuit and the power supply terminal of the LED backlight source by the first voltage output terminal;

a second boost-type DC/DC topology circuit, electrically coupled to the power supply terminal of the source driving circuit by the second voltage output terminal, wherein the second voltage output terminal further is electrically coupled to the first boost-type DC/DC topology circuit by the first switching element and thereby electrically coupled to the first voltage output terminal;

a LED dimming control circuit, electrically coupled to the second feedback input terminals for performing a dimming operation to the LED backlight source; and a first multiplexer, comprising a first data input terminal, a second data input terminal and a first data output terminal, wherein the first data input terminal is electrically coupled to the first feedback input terminal, the second data input terminal is electrically coupled to the second feedback input terminals, the first data output terminal is electrically coupled to the first boost-type DC/DC topology circuit and thereby alternatively electrically communicated with the first data input terminal or the second data input terminal for providing the first boost-type DC/DC topology circuit with a feedback input voltage.

12. The liquid crystal display device according to claim 11, wherein the power management and control chip further comprises:

an enable control circuit, electrically coupled to the first multiplexer to thereby control the first data output terminal of the first multiplexer to alternatively communicate with the first data input terminal or the second data input terminal.

13. The liquid crystal display device according to claim 12, wherein the power management and control chip further comprises:

a second multiplexer, comprising a third data input terminal, a fourth data input terminal and a second data output terminal, wherein the third data input terminal and the fourth data input terminal respectively are electrically coupled to a first reference voltage and a second reference voltage, the second data output terminal is electrically coupled to the first boost-type DC/DC topology circuit and thereby alternatively electrically communicated with the third data input terminal or the fourth data input terminal for providing the first boost-type DC/DC topology circuit with a feedback reference voltage according to the control of the enable control circuit to the second multiplexer.

14. The liquid crystal display device according to claim 11, wherein the power management and control chip further comprises:

a negative charge pump control circuit, electrically coupled to a logic low power supply terminal of the gate driving circuit by a negative charge pump circuit externally coupled to the power management and control chip.

15. The liquid crystal display device according to claim 11, wherein the power management and control chip further comprises:

a delay control circuit, for detecting the voltage on the second voltage output terminal and thereby enabling the first switching element when the detected voltage on the second voltage output terminal arrives at a preset voltage.

* * * * *